US007756454B2

(12) United States Patent
Crean et al.

(10) Patent No.: US 7,756,454 B2
(45) Date of Patent: Jul. 13, 2010

(54) HYBRID SINGLE PASS, MULTI-PASS FULL COLOR PRINTING SYSTEM

(75) Inventors: Peter A Crean, Penfield, NY (US); Michael R Furst, Penfield, NY (US)

(73) Assignee: Xerox Corporation, Norwalk, CT (US)

( * ) Notice: Subject to any disclaimer, the term of this patent is extended or adjusted under 35 U.S.C. 154(b) by 218 days.

(21) Appl. No.: 12/163,010

(22) Filed: Jun. 27, 2008

(65) Prior Publication Data

US 2009/0324303 A1 Dec. 31, 2009

(51) Int. Cl.
*G03G 15/01* (2006.01)

(52) U.S. Cl. ..... 399/299; 399/298; 399/302; 399/309

(58) Field of Classification Search ..... 399/297–300, 399/302, 306, 308, 309
See application file for complete search history.

(56) References Cited

U.S. PATENT DOCUMENTS 4,728,987 A * 3/1988 Diola et al. ..... 399/227
5,260,725 A 11/1993 Hammond
5,347,353 A 9/1994 Fletcher
5,576,824 A 11/1996 Folkins
5,613,176 A 3/1997 Grace
5,807,652 A 9/1998 Kovacs
5,837,408 A 11/1998 Parker et al.
6,047,155 A * 4/2000 Pietrowski et al. ..... 399/296
6,352,806 B1 3/2002 Dalal
7,548,716 B2 * 6/2009 Radulski ..... 399/298

* cited by examiner

*Primary Examiner*—David P Porta
*Assistant Examiner*—Jessica L Eley
(74) *Attorney, Agent, or Firm*—Fay Sharpe LLP

(57) ABSTRACT

A hybrid single pass, multi-pass full color printing system is provided and includes (a) a moveable intermediate transfer belt (ITB) mounted within a machine frame and having a path of movement; (b) a plurality of single pass image output modules mounted along the path of movement, each having imaging devices including an image carrying member and a single developer housing containing a single color developer for forming an image in a single pass on the image carrying member for transfer onto the ITB; and (c) at least one single pass, multi-pass image output module mounted along the path of movement and having imaging devices including an image bearing member and a plural number of selectable developer housings, and each of the selectable developer housings containing a single spot color developer for forming spot color images in single passes and in multiple passes on the image bearing member for transfer onto the ITB.

20 Claims, 3 Drawing Sheets

HYBRID SINGLE PASS, MULTI-PASS FULL COLOR PRINTING SYSTEM

The present disclosure relates to image producing machines and, more particularly to a hybrid single pass, multi-pass full color printing system including a plurality of resident selectable spot colors for producing custom and spot color images.

BACKGROUND OF DISCLOSURE

Image producing machines, for example electrostatographic image producing machines, form images in cycles by first exposing an image of an original document onto a substantially uniformly charged photoreceptive member. The photoreceptive member has a photoconductive layer. Ordinarily, exposing the charged photoreceptive member with the image discharges areas of the photoconductive layer corresponding to non-image areas of the original document, while maintaining the charge in the image areas. In discharge area development, the reverse is true where the image areas are the discharged areas and the non-image areas are the charged areas. Thus in either case, a latent electrostatic image of the original document is created on the photoconductive layer of the photoreceptive member.

Charged developing material is subsequently deposited on the photoreceptive member to develop the latent electrostatic image areas. The developing material may be a liquid material or a powder material. The charged developing material is attracted to the charged image areas on the photoconductive layer. This attraction develops the latent electrostatic image into a visible toner image. The visible toner image is then transferred from the photoreceptive member, either directly or after an intermediate transfer step, to a copy sheet or other support substrate as an unfused toner image which is then heated and permanently affixed to the copy sheet, resulting in a reproduction or copy of the original document. In a final step, the photoconductive surface of the photoreceptive member is cleaned to remove any residual developing material in order to prepare it for successive imaging cycles.

In color electrostatographic printing, rather than forming a single latent image on the photoconductive surface, successive latent images, corresponding to different color separations, must be created. Each single color latent electrostatic image is developed with a corresponding colored toner. This process is repeated for a plurality of cycles. By anyone of several processes, each single-color toner image is eventually superimposed over the other and then results in a single color toner image on the copy sheet. Thereafter, the color toner image is also heated and then permanently fixed to a copy sheet, creating a full-color copy.

In a conventional tandem color printing process, four imaging systems are typically used. Photoconductive drum imaging systems are typically employed in tandem color printing due to the compactness of the drums. Although drums are used in the preferred embodiments, a tandem system can alternatively use four photoconductive imaging belts instead of the drums. Each imaging drum or belt system charges the photoconductive surface thereof, forms a latent image on the thereon, develops it as a toned image and then transfers the toned image to an intermediate belt or to a print media. In this way, yellow, magenta, cyan, and black single-color toner images are separately formed and transferred. When superimposed, these four toned images can then be fused, and are capable of resulting in a wide variety of colors.

In image-on-image color printing, an endless photoreceptor belt, a controller and a series of imaging subassemblies are employed that each include a charging unit, a color separation latent image exposure ROS unit or LED print bar, and a corresponding color toner development unit. As the endless photoreceptor belt moves in an indicated direction, an image frame thereon is charged, exposed and developed, in succession, by each imaging subassembly, with each imaging subassembly thus forming a color separation image corresponding to color separation image input video data from the controller. After the first imaging subassembly forms its color separation toner image, that color separation toner image is then recharged and re-exposed to form a different color separation latent image, and then correspondingly developed by the next imaging subassembly. After the final color separation image is thus formed, the fully developed color image is then ready to be transferred from the image frame at transfer station to a print media.

Color images with more than four colors are gaining in popularity and there is therefore an increasing desire to provide more than 4 color capability in printing systems. Some current printing systems are available with 5 to 7 different color modules, but at a great cost. Typically in tandem production printing systems in which such colors are produced by xerographic modules for example, each separate color requires the addition of a separate tandem xerographic module. This is true not only for the primary colors, Cyan, Magenta, Yellow and Black (C, M, Y, K), but also for spot colors. As such, it is generally accepted that the greater the number of colors, the greater the footprint or size of the overall production system.

Following is a discussion of prior art, incorporated herein by reference, which may bear on the patentability of the present disclosure. In addition to possibly having some relevance to the question of patentability, these references, together with the detailed description to follow, are intended to provide a better understanding and appreciation of the present disclosure.

U.S. Pat. No. 5,347,353 issued Sep. 13, 1994 to Fletcher and entitled "Tandem high productivity color architecture using a photoconductive intermediate belt" discloses a system in which tandem, high productivity color images are formed by using a photoconductive belt as an imaging surface and as a transferring device. A colored image is produced comprising a plurality of color layers. The apparatus includes a charging device, an image forming device, and a developing device located along a photoconductive belt to form a toned image layer on the belt. Additional color layers may be provided by either photoreceptive imaging drums or additional photoconductive belts.

U.S. Pat. No. 5,576,824 issued Nov. 19, 1996 to Folkins and entitled "Five cycle image on image printing architecture", discloses a 5 cycle color electrostatographic printing architecture. In the first cycle the photoreceptor is erased, charged, exposed to create a first electrostatic latent representation, and developed with a first color of toner. In the second cycle the photoreceptor is recharged using a split recharging scheme, exposed to light to create a second electrostatic latent representation, and developed with a second color of toner. In the third cycle the photoreceptor is recharged using a split recharging scheme, exposed to create a third latent representation, and developed using a third color of toner. In the fourth cycle the photoreceptor is recharged using a split recharging scheme, exposed to create a fourth latent representation, and developed with a fourth color of toner. In the fifth cycle the photoreceptor and the four toner layers are exposed to a pretransfer erase lamp, charged to assist in transfer, transferred onto a substrate using a corona generating device. The substrate is separated from the photoreceptor and passed through a fusing station. Meanwhile the photoreceptor is cleaned in preparation for printing another image.

U.S. Pat. No. 5,837,408 issued Nov. 17, 1998 to Parker et al. and entitled "Xerocolography tandem architectures for high speed color printing" discloses a color imaging system that uses two xerocolography engines in tandem. Each of the two xerocolography engines is capable of creating three perfectly registered latent images with subsequent development thereof in a spot next to spot manner. Each engine is provided with three developer housing structures containing five different color toners including the three subtractive primary colors of yellow, cyan and magenta. Two of the primary colors plus black are used with one of the engines. The third primary color is used with the second tandem engine which also uses one of the primary colors used with the first engine as well as a fifth color which may be a logo or a gamut extending color. The color imaging capability provided is effected without any constraints regarding the capability of the laser imaging device to image through previously developed components of a composite image. Also, the development and cleaning field impracticalities imposed by quad and higher level imaging of the prior art are avoided. Moreover, the number of required image registrations compared to conventional tandem color imaging is minimal. Therefore, only one registration is required compared to three or four by conventional tandem engine imaging systems.

U.S. Pat. No. 5,807,652 issued Sep. 15, 1998 to Kovacs and entitled "Process for producing process color in a single pass with three wavelength imager and three layer photoreceptor" discloses a process for producing eight distinct colors, (viz. K, C, M, Y, CM, CY, MY and W) with a single exposure in a 3.lambda./3L imaging system is provided. The use of xerocolography with a fifth developer housing containing the same color toner as one of the four normally used developer housings and suitable flood exposure devices overcomes the limitations of prior art K+6 imaging systems which utilize an exposure device capable of emitting light beams at three different wavelengths and a photoreceptor having three layers responsive to the three wavelengths.

U.S. Pat. No. 4,728,987 issued Mar. 1, 1988 to Diola et al. and entitled "Carousel-mounted modular development units for electrographic printer" discloses a toner or development unit arrangement for an electrographic printer or plotter in which each of the toner units is modular and can be readily removed and replaced by the user. In addition, the units are mounted in a rotating support, generally referred to herein as a carousel, which is compact and which rotates each of the units into the same position for printing, simplifying the movements of the medium past the development units. As a result, the moving parts within each unit are driven by the same set of drivers, to which each toner unit is coupled by coupling means when a selected toner is in the printing position. Also, disclosed is a method of quickly establishing a toner meniscus where the toner unit engages the medium surface as soon as the toner pump is activated. Further, cam operated means is provided to operate the medium cutter in conjunction with a cutter stepper motor.

U.S. Pat. No. 5,613,176 issued Mar. 18, 1997 to Grace and entitled "Image on image process color with two black development steps" discloses a printing system using a recharge, expose and development image on image process color system in which there is an optional extra black development step. The printing system may be a system where all of the colors are developed in a single or a multi-pass system where each color is developed in a separate pass. The additional black development step results in optimal color quality with black toner being developed in a first and/or last sequence. Having more than one black development station allows low gloss and high gloss black toner to be applied to the same image, enabling the very desirable combination of low gloss text and high gloss pictorials on the same page.

U.S. Pat. No. 5,260,725 issued Nov. 9, 1993 to Hammond and entitled "Method and apparatus for registration of sequential images in a single pass, color xerographic printer" discloses a single pass, hybrid ROS/print bar system provides a plurality of latent images which may subsequently be developed in different colors. A ROS unit is initially aligned so that each scan line is registered in the process direction. The alignment is accomplished by forming a pair of opposed V-shaped apertures in the surface of the belt and detecting scan line cross-over of the legs of the V. These cross-overs are manifested as two sets of pulses generated by sensors associated with each target leg. The time differences between pulse sets are compared and the scan line is rotated until the time differences are equal. Once the ROS is registered for skew, one or more print bars are registered by enabling non-image pixels and comparing the output generated by detectors when the lit pixels are viewed through the V-shaped aperture.

U.S. Pat. No. 6,352,806 issued Mar. 5, 2002 to Dalal and entitled "Low toner pile height color image reproduction machine" discloses a low toner pile height color image reproduction machine for forming full-gamut toner images approximating a "look and feel" of offset lithographic images. The reproduction machine includes a single moveable endless image bearing member having a path of movement; at least a charging device mounted along the path of movement for uniformly charging a portion of the image bearing member; a controller including an image processor for converting digital image signals into at least seven bitmaps pixels of color separation images including black (K), cyan (C), red (R), magenta (M), blue (B), green (G) and yellow (Y); at least an exposure device mounted along the path of movement for imagewise exposing the portion of the single moving image bearing member to a light pattern of a first one of the at least seven bitmaps to form a first color separation latent image having first image areas and first background areas; and at least a development apparatus mounted along the path of movement for developing the first image areas of the first color separation latent image using toner particles having a color corresponding to that of the first one of the at least seven bitmaps.

In conventional printing systems such as the examples mentioned above, because of footprint concerns, it is typical to limit the number of resident or available color modules or development stations in each system. It is understandable therefore to limit the number of available spot color modules in such printing systems, (often to not more than two). As a consequence, conventional printing systems have just about two spot colors available in them at a time. Printing with more than two spot colors therefore ordinarily requires changing or swapping two new different color toners or developers for those color developers already in the printing system or machine. The color developer changing or swapping process is often a time consuming process that in some cases involves purging, cleaning, and refilling a developer housing. In general, this change over strategy requires the customer or operator to clean out the existing spot color housing and re-fill it with a new and different color. Kodak's NexPress system for example follows this strategy.

Attempts to address such customer complaints have included equipping some printing systems with customer removeable development units (CRU's) that include attached toner bottles. To minimize what otherwise would significant downtime, such CRU's can be pre-loaded with the appropriate color developer or toner and then held or stored outside the machine until that appropriate color is needed in the machine at which time it is then loaded into the machine. Significantly large ones are typically held or stored as such on a cart that can be wheeled into place as a unit and then swapped with one already in the machine. Even so, the process involves hard physical work, and must be done within safety and design constraints. The strategy also requires that a customer keep spare development and supply units at the ready for as many colors as they would need.

Color changeover processes as such are common cause of complaints from customers. This is because the time it takes conventionally to change from one set of spot colors to another set of spot colors is critical production time to customers. It is clear therefore that a better change over strategy or technology is needed.

SUMMARY OF DISCLOSURE

In accordance with the present disclosure, there is provided a hybrid single pass, multi-pass full color printing system that includes (a) a moveable intermediate transfer belt (ITB) mounted within a machine frame and having a path of movement; (b) a plurality of single pass image output modules mounted along the path of movement, each having imaging devices including an image carrying member and a single developer housing containing a single color developer for forming an image in a single pass on the image carrying member for transfer onto the ITB; and (d) at least one single pass, multi-pass image output module mounted along the path of movement and having imaging devices including an image bearing member and a plural number of selectable developer housings, and each of the selectable developer housings containing a single spot color developer for forming spot color images in single passes and in multiple passes on the image bearing member for transfer onto the ITB.

DETAILED DESCRIPTION

Figure 1:
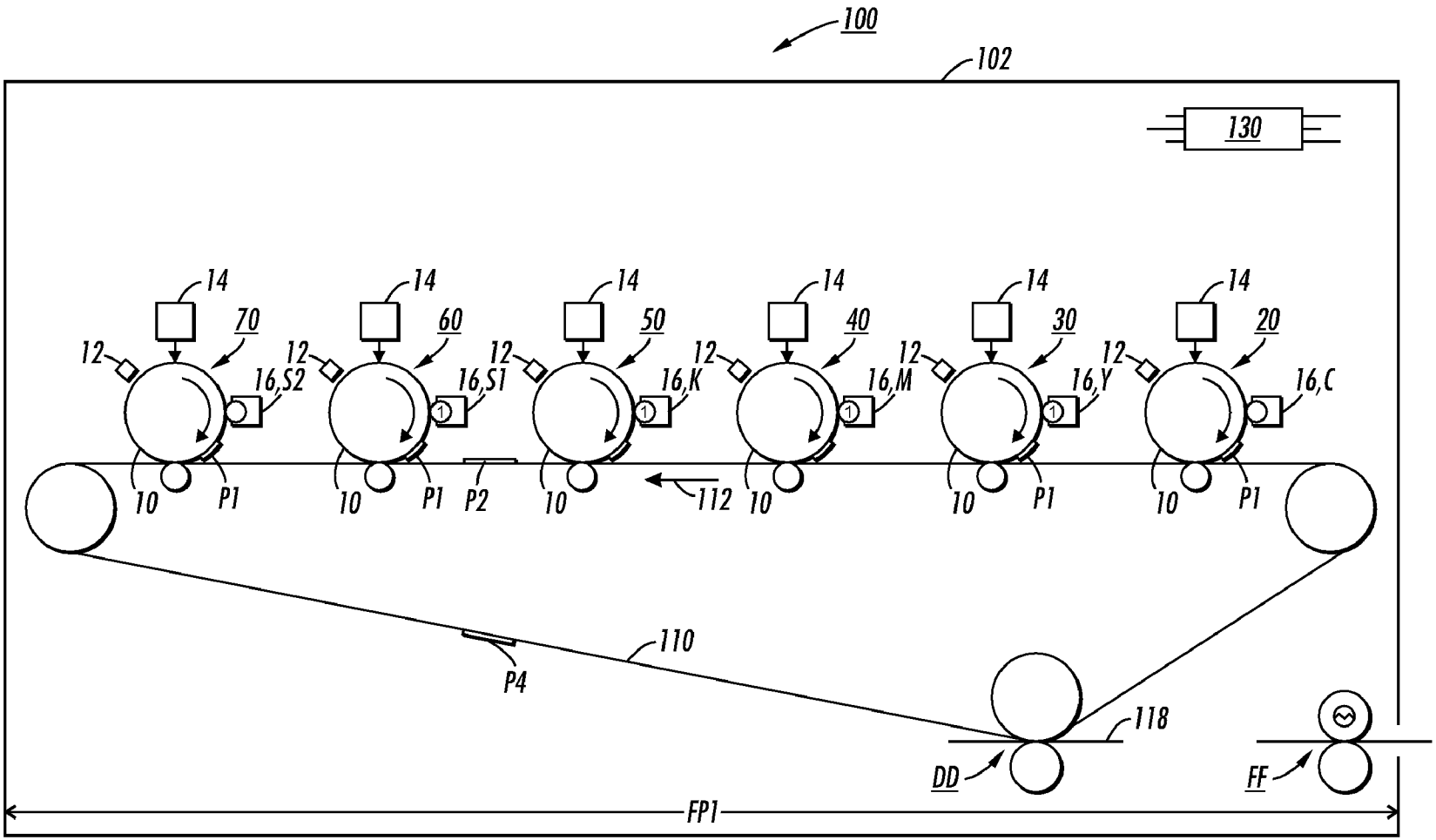
FIG. 1 (PRIOR ART)
FIG. 1 is a schematic elevational view of a prior art embodiment of a typical conventional single pass spot color printing system.

Referring first to FIG. 1, a schematic representation of an exemplary conventional prior art single pass tandem color printing system 100 having a footprint FP1 is shown. As illustrated, it includes a moveable intermediate transfer belt (ITB) 110 having a path of movement 112 within a machine frame 102. It also includes 6 single pass image output modules 20, 30, 40, 50, 60, 70 mounted along the path of movement 112 for forming and transferring single color (separation color) images P1 (in one or a single pass), and in registration, onto the ITB 110 to form a multi-color or full color image P4 on the ITB. Each single pass image output module 20, 30, 40, 50, 60, 70 for example includes imaging devices comprising an image carrying photoreceptor 10 in the form of a drum, a charging device 12, an exposure device 14, and a developer housing 16 containing a desired color developer C, Y, M, K, S1, S2. As shown, four 20, 30, 40, 50 of the six modules include process color developers Cyan, Magenta, Yellow and Black (CYMK), and the other two modules 60, 70 contain spot color developers S1, S2. All operating components of the system are connected to and under the control of a controller 130.

In operation, a full color image consisting of at most CYMKS1S2 can be formed on the ITB through a single pass process in which each module 20, 30, 40, 50, 60, 70 forms a single color (separation color) image of C, Y, M, K, S1 and S2 developers, all in the same pass, and transfers it in timed registration onto the ITB 110. The resulting full color image P4 on the ITB 110 can then be subsequently transferred at a transfer station DD onto a finished image carrying substrate 118 and thereafter fused at a fusing station FF.

It is therefore obvious that custom or specialized spot color images requiring more than 2 spot colors cannot be formed by this conventional exemplary system 100. Additionally, custom or specialized spot color images calling for different spot colors, for example S3, S4 or other, can only be formed following an undesirable time consuming changeover process in which S1 and S2 are replaced by some strategy with S3 and S4. As described above, current or existing strategies are time consuming and a source of consumer complaints.

In image printing systems "spot colors" or "high-fidelity" colors are becoming more and more desirable. These "spot colors" or "high-fidelity" colors can be described as additional colors that augment the conventional cyan, magenta, yellow and black (CMYK) primary colors that are ordinarily used to produce full process color images. As such, spot colors can be defined as colors that expand the color gamut of image marking devices, either in order closely match the actual color of an image be reproduced, or to produce a color image that meets specific customer requests ("custom colors"). Often such colors which tend to be outside the color gamut are colors comprising two or more high intensity colorants. Such spot colors in electrostatographic or ink jet printing therefore more closely emulate standardized spot colors defined by Pantone. It is therefore advantageous to provide a printing system that makes more of these "spot colors" or "high-fidelity" colors easily available for imaging.

Figure 2:
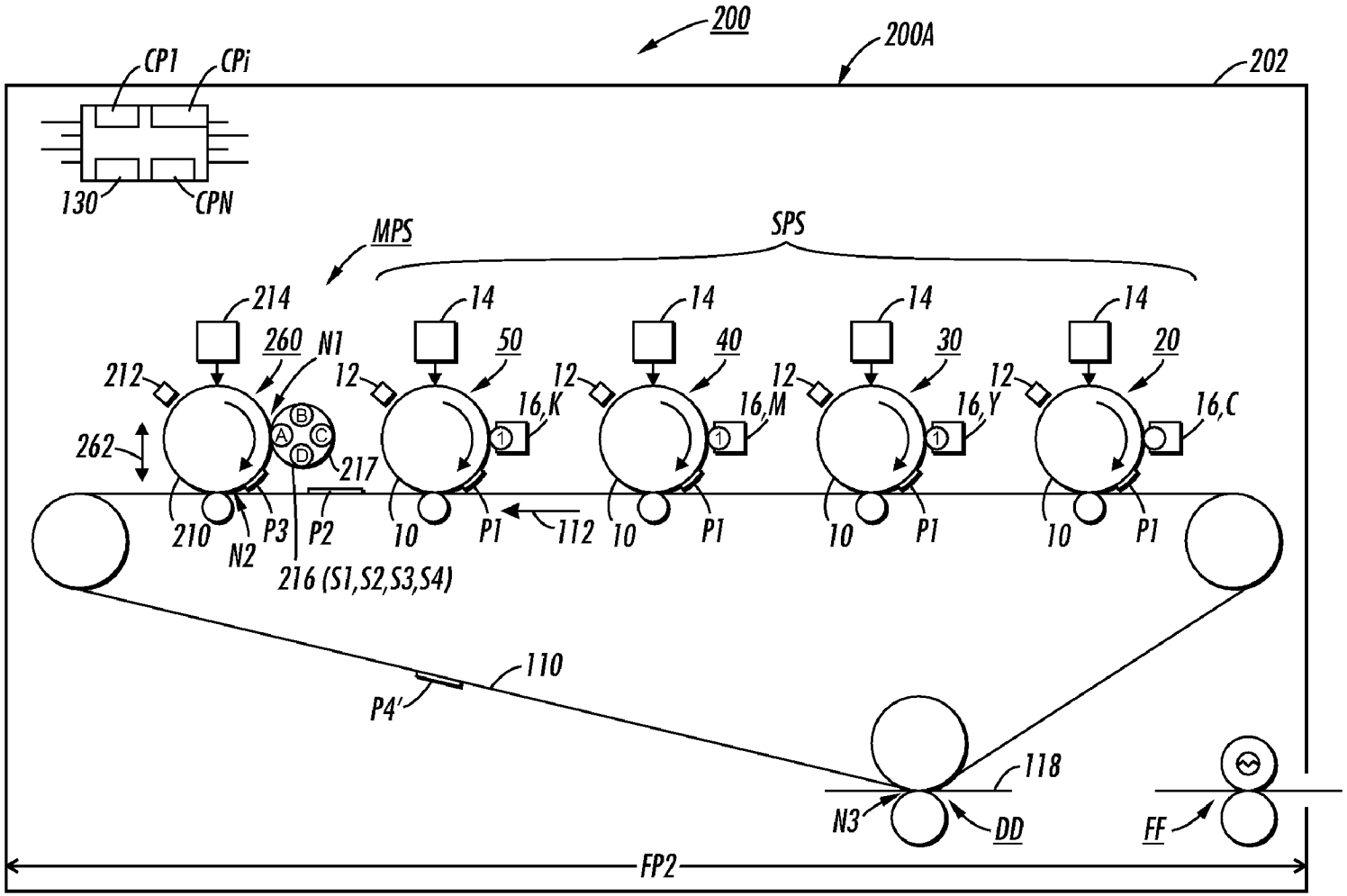
FIG. 2 is a schematic elevational view of a first embodiment of the hybrid single pass, multi-pass color printing system of the present disclosure.
Figure 3:
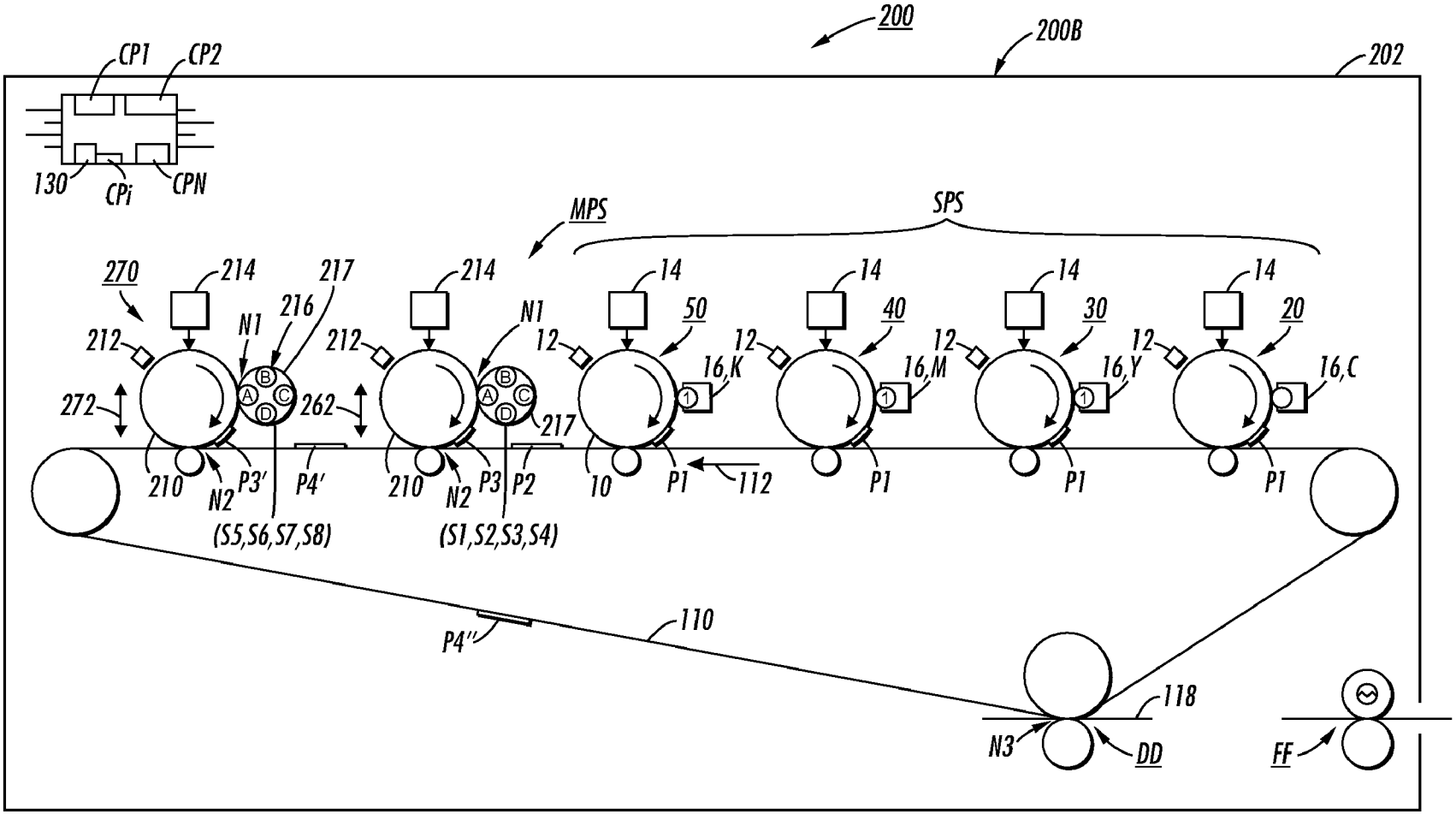
FIG. 3 is the schematic elevational view of a second embodiment of the hybrid single pass, multi-pass color printing system of the disclosure.

Referring next to FIGS. 2 and 3, first and second embodiments 200A, 200B of the hybrid single pass, multi-pass full color printing system 200 of the present disclosure are illustrated. In each embodiment, the hybrid single pass, multi-pass printing system 200A, 200B combines within a machine frame 202, (a) a tandem single pass color architecture segment SPS, with (b) a multi-pass spot color architecture segment MPS. The order of the segments SPS, MPS as shown is for illustration purposes only. The five or six xerographic modules as shown could be arranged in any order that makes the most sense in optimizing the performance or operation of the system. In each embodiment, all operating components of the system are connected to and under the control of a programmable controller 130 having and capable of running many system control programs CP1-CPi-CPN.

As illustrated, the tandem single pass color architecture segment SPS (like the prior art system of FIG. 1) includes a plural number of single pass image output xerographic modules 20, 30, 40, 50 with each such xerographic module having only one developer housing 16 containing a different color developer C, Y, M, K. Each such single pass image output xerographic module 20, 30, 40, 50 for example similarly includes imaging devices comprising an image carrying photoreceptor 10 in the form of a drum, a charging device 12, an exposure device 14, and the developer housing 16 containing a color developer C, Y, M, K. Thus as shown, the plural number (four) of the tandem single pass color architecture segment SPS include process color developers Cyan, Magenta, Yellow and Black (CYMK). In operation, a process color image P2 consisting of CYMK can be formed on the ITB through a conventional process in which each of these modules 20, 30, 40, 50 forms a single color (separation color) image P1 of C, Y, M or K developers all in one single pass, and transfers it in timed registration onto the ITB 110.

The multi-pass color architecture segment MPS on the other hand comprises at least one single pass, multi-pass xerographic image output module 260, 270 that for example is moveable 262, 272 into and out of image transfer nip N2 with the ITB 110 for engaging and disengaging the image transfer nip N2. In general however, the engagement and disengagement of the image transfer nip N2 can be accomplished by any suitable means including moving the ITB 110 into and out of such engagement with the image bearing member 210. The at least one single pass, multi-pass xerographic image output module 260, 270 is a single pass module when operated with the image transfer nip N2 engaged with the ITB 110, and a multi-pass module when operated with the image transfer nip N2 disengaged.

When the at least one single pass, multi-pass xerographic image output module 260, 270 is in the multi-pass mode, it is operated in the same manner as disclosed for example in U.S. Pat. No. 5,576,824 issued Nov. 19, 1996 to Folkins and entitled "Five cycle image on image printing architecture". Accordingly, with the nip N2 disengaged so that there is no transfer to the ITB 110, in a first pass the image bearing member or photoreceptor 210 will be erased, charged, exposed to create a first electrostatic latent representation, and then developed with a first spot color S1 of toner in the carousel assembly 217. In the second pass, the carousel assembly 217 is indexed to present a second spot color S2 for development, while the photoreceptor 210 is recharged using a split recharging scheme, exposed to light to create a second electrostatic latent representation, which is then developed with the second spot color S2. In the third pass if necessary, the carousel assembly 217 is again indexed to present a third spot color S3 for development, while the photoreceptor 210 is again recharged using a split recharging scheme, exposed to create a third latent representation, and developed using the third spot color S3. In the fourth pass if also necessary, the carousel assembly 217 is again indexed to present a fourth spot color S4 for development, while the photoreceptor 210 is again recharged using a split recharging scheme, exposed to create a fourth latent representation, and developed with the fourth spot color S4.

By the end of this fourth pass or final spot color image development pass, the transfer nip N2 with the ITB 110 is re-engaged, and the four spot color toner images or layers on the photoreceptor 210 are then simultaneously transferred onto the ITB 110 in registration with a CYMK color image already thereon.

The first embodiment 200A of the hybrid single pass, multi-pass full color printing system 200 as shown in FIG. 2 has only one such single pass, multi-pass xerographic module 260, but as shown in FIG. 3, two or more such multi-pass xerographic module 260, 270 are equally possible. Each multi-pass image output xerographic module 260, 270 for example similarly includes imaging devices comprising an image bearing member 210 in the form of a drum photoreceptor, a charging device 212, an exposure device 214, and a plural number of selectable developer housings 216A, 216B, 216C and 216D each containing a different desired color developer. As further shown, the plural number of selectable developer housings 216A, 216B, 216C and 216D can be in the form of a carousel development system 216 that has the multiple developer housings 216A, 216B, 216C and 216D that are indexable, and that each contain a different color developer S1, S2, S3, S4, such as spot colors or high intensity colorant developers. In operation, a carousel assembly 217 of the carousel development system 216 can be controlled to index the different developer housings 216A, 216B, 216C and 216D into and out of image development nip N1 contact with the image bearing member 210 of the multi-pass xerographic module 260, 270.

The at least one single pass, multi-pass xerographic image output module 260, 270 can also be operated in the manner disclosed in commonly owned U.S. Pat. No. 6,352,806 cited in the background section above, and relevant portions of which are hereby incorporated by reference. The U.S. Pat. No. 6,352,806 system as summarized above is a low toner pile height color image reproduction machine for forming full-gamut toner images approximating a "look and feel" of offset lithographic images. The reproduction machine includes a single moveable endless image bearing member having a path of movement; at least a charging device mounted along the path of movement for uniformly charging a portion of the image bearing member; a controller including an image processor for converting digital image signals into at least seven bitmaps pixels of color separation images including black (K), cyan (C), red (R), magenta (M), blue (B), green (G) and yellow (Y); at least an exposure device mounted along the path of movement for image-wise exposing the portion of the single moving image bearing member to a light pattern of a first one of the at least seven bitmaps to form a first color separation latent image having first image areas and first background areas; and at least a development apparatus mounted along the path of movement for developing the first image areas of the first color separation latent image using toner particles having a color corresponding to that of the first one of the at least seven bitmaps.

The multi-pass method of the U.S. Pat. No. 6,352,806 system includes the steps of uniformly recharging the image frame portion containing the first color separation toner image (that is, toner in the first image areas, and no toner in the first background areas); image-wise re-exposing the first background areas of the recharged image frame portion to a light pattern of a second one of the at least seven bitmaps of pixels of color separation images so as to form a second color separation latent image having second image areas and second background areas; forming a second toner separation image in registration with the first toner separation image by developing the second image areas of the second color separation latent image using toner particles having a color corresponding to that of the second one of the at least seven bitmaps.

For each of the remaining ones of the at least seven bitmaps of color separation images, the multi-pass method of the U.S. Pat. No. 6,352,806 system then involves repeating the steps of recharging, re-exposing, and developing to form a toner image (in the image frame portion) of such each of the at least seven bitmaps of color separation images. The result is a full-gamut KCRMBGY multicolor toner image that has a relatively high level of image-next-to-image registration as well as relatively low toner pile height, which thus appears to have a "look and feel" of offset lithographic images.

Thus in either case, the at least one single pass, multi-pass xerographic image output module 260, 270, with the image transfer nip N2 disengaged, can be operated in accordance with the multi-pass method of the U.S. Pat. No. 6,352,806 system of U.S. Pat. No. 5,576,824. Given the S1, S2, S3 and S4 spot color developers of the single pass, multi-pass xerographic image output module 260 for example, the result of operating it as such similarly can be different multicolor spot color images on the image bearing member 210 that each have a relatively high level of image-next-to-image registration as well as relatively low toner pile height, and that can then be subsequently transferred onto the ITB 110 through re-engagement of the image transfer nip N2.

In operation, the carousel assembly 217 under the selection and control of the controller 130 will index from one developer housing 216A, 216B, 216C, 216D, containing a particular color developer, for example S1, (and in development contact with the image bearing member 210) to another of the other housings on the carousel assembly that contains a different but needed color developer, for example S2. As such, when the multi-pass image output module 260, 270 is out of image transfer nip (N2) contact with the ITB 110, different color separation images P1 can be formed thereby on the image bearing member 210 in a timed registered manner during each pass or full image forming rotation of the single pass, multi-pass xerographic module 260, 270. A multiple spot color image P3, P3' (FIG. 3) thus can first be formed on the image bearing member 210 and then subsequently transferred onto the ITB 110 in timed registration with a process color CYMK image P2 already on the ITB 110 from the single pass architecture segment SPS as described above, thus resulting in a highly tailored, full color or custom color image P4' (FIG. 2) or P4" (FIG. 3) on the ITB 110. The highly tailored, full color or custom color image P4', P4" on the ITB 110 can then be transferred subsequently at a finished image transfer station DD onto a finished image carrying substrate 118, and thereafter fused at a fusing station FF.

By containing a different color developer as such, the multiple developer housings 216A, 216B, 216C, 216D thus can make available at the one single pass, multi-pass xerographic module 260, 270 an unconventionally large number of selectable resident spot color developers (for example as many as four different color developers, S1, S2, S3, S4) from one module, without increasing the footprint FP2 of the resulting hybrid single pass, multi-pass printing system 200A for example. This is because in this configuration there is only one image bearing member waterfront space for all the 4 different developer housings 216A, 216B, 216C, 216D on the carousel assembly 217. This saves waterfront space as compared to a conventional multi-pass configuration in which each of the developer housings would have its own waterfront space directly on the image bearing member or photoreceptor. Advantageously therefore, although the resulting hybrid single pass, multi-pass printing system 200 as shown in FIG. 2 offers double the number of spot color developers (4 versus 2) of the conventional prior art system of FIG. 1, it has only 5 xerographic modules and hence a relatively smaller foot print FP2 that is less than the footprint FP1 of the similar but lesser capability prior art system of FIG. 1.

Thus the multi-pass architecture segment MPS, having only one module 260 for example and 4 spot colors S1, S2, S3, S4, can form a first sequence spot color or multiple spot color image P3 in one, two, three or four passes on its image bearing member 210 for timely and registered transfer with the CYMK process color image P2 already on the ITB. This thereby enables the hybrid single pass, multi-pass system 200A of the present disclosure with just one MPS module 260, 270 and 4 spot colors to achieve many different custom P4' color images CYMKS1, CYMKS1S2, CYMKS1S2S3 and CYMKS1S2S3S4 on the ITB. Other combinations of 6 and 7 such full color images, for example, CYMKS2S3, CYMKS1S3, and CYMKS2S3S4, etc. are of course also possible.

In the second embodiment of FIG. 3, the hybrid single pass, multi-pass color printing system 200 includes two multi-pass xerographic modules 260, 270, each of which functions independently but in the same manner (as described for the one already). Advantageously, the two multi-pass xerographic modules 260, 270, expand the set of spot colors available for use in the system 200 without operator intervention from 4 (S1, S2, S3 and S4), to 8 by adding S5, S6, S7 and S8.

To recapitulate, the hybrid single pass, multi-pass full color printing system includes (a) a machine frame; (b) a moveable intermediate transfer belt (ITB) mounted within the machine frame and having a path of movement; (c) a plurality of single pass image output modules mounted within the machine frame along the path of movement, each single pass image output module of the plurality of single pass image output modules having imaging devices including an image carrying member and a single developer housing containing a single color developer for forming a color image in a single pass on the image carrying member for transfer onto the ITB; and (d) at least one single pass, multi-pass image output module also mounted within the machine frame along the path of movement, the at least one single pass, multi-pass image output module having imaging devices including an image bearing member and a plural number of selectable developer housings, and each of the selectable developer housings containing a single spot color developer for forming spot color images in single passes and in multiple passes on the image bearing member for transfer onto the ITB.

Advantageously, the multi-pass xerographic module 260, 270 with the carousel developer housings 216A, 216B, 216C, 216D will be able to do an unconventionally high number and mixture of spot color images, as well as importantly be able to change over form one spot color developer to a new one on the carousel assembly in a tiny fraction of the time of similar conventional change over strategies. Furthermore, as long as the spot color developer change is within the set of spot colors S1, S2, S3 and S4, as well as S5, S6, S7 and S8, loaded in the carousel assembly of the at least one single pass, multi-pass xerographic module 260, 270 in the hybrid single pass, multi-pass color printing system 200, there will be no customer intervention.

The hybrid single pass, multi-pass system 200 of the present disclosure thus can enable 4 process colors (CMYK) from the single pass architecture segment SPS, and any number of the N (where N is greater than two) pre-loaded spot colors (S1-S8) from the multi-pass spot color segment MPS. As shown, this is possible even in the relatively smaller footprint, 5 module system as illustrated in the first embodiment FIG. 2. This of course represents a significant advantage over even a conventional 6 module system as shown in FIG. 1. As further illustrated in the second embodiment of FIG. 3, in a 6 module version of the hybrid single pass, multi-pass system 200 of the present disclosure, the number pre-loaded spot colors can be doubled to 2N. In either embodiment, the hybrid single pass, multi-pass system 200 of the present disclosure clearly enables spot color changeovers (possibly from page to page while printing) at relatively significant reduced times from what customers have available to them conventionally. Such rapid changeovers are a very significant customer advantage, as well as an enabler to making five-plus and six-plus color module printing system more attractive in the market.

As can be seen, there has been provided a hybrid single pass, multi-pass full color printing system that includes (a) a moveable intermediate transfer belt (ITB) mounted within a machine frame and having a path of movement; (b) a plurality of single pass image output modules mounted along the path of movement, each having imaging devices including an image carrying member and a single developer housing containing a single color developer for forming an image in a single pass on the image carrying member for transfer onto the ITB; and (d) at least one single pass, multi-pass image output module mounted along the path of movement and having imaging devices including an image bearing member and a plural number of selectable developer housings, and each of the selectable developer housings containing a single spot color developer for forming spot color images in single passes and in multiple passes on the image bearing member for transfer onto the ITB.

The claims, as originally presented and as they may be amended, encompass variations, alternatives, modifications, improvements, equivalents, and substantial equivalents of the embodiments and teachings disclosed herein, including those that are presently unforeseen or unappreciated, and that, for example, may arise from applicants/patentees and others.

What is claimed is:

1. A hybrid single pass, multi-pass full color printing system comprising:

a) a machine frame b) a moveable intermediate transfer belt (ITB) mounted within said machine frame and having a path of movement;

c) a plurality of single pass image output modules mounted within said machine frame along said path of movement, each single pass image output module of said plurality of single pass image output modules having imaging devices including an image carrying member and a single developer housing containing a single color developer for forming a color image in a single pass on said image carrying member for transfer onto said ITB; and d) at least one single pass, multi-pass image output module also mounted within said machine frame along said path of movement, said at least one single pass, multi-pass image output module having imaging devices including an image bearing member and a plural number of selectable developer housings, and each of said selectable developer housings containing a single spot color developer for forming spot color images in single passes and in multiple passes on said image bearing member for transfer onto said ITB.

2. The hybrid single pass, multi-pass full color printing system of claim 1, wherein said plurality of single pass image output modules comprises a Cyan, a Magenta, a Yellow and a Black color image output modules.

3. The hybrid single pass, multi-pass full color printing system of claim 1, wherein said at least one single pass, multi-pass image output module comprises spot color image output modules.

4. The hybrid single pass, multi-pass full color printing system of claim 1, wherein each said image carrying member comprises a drum photoreceptor.

5. The hybrid single pass, multi-pass full color printing system of claim 1, wherein said image bearing member of said at least one single pass, multi-pass image output module forms an engageable and disengageable image transfer nip with said ITB.

6. The hybrid single pass, multi-pass full color printing system of claim 5, wherein each of said at least one single pass, multi-pass module is a xerographic module and is operational in a multiple pass manner when said image transfer nip is disengaged for forming a multiple spot color image on said image bearing member.

7. The hybrid single pass, multi-pass full color printing system of claim 5, wherein each of said at least one single pass, multi-pass module is a xerographic module and is operational to transfer a spot color image from said image bearing member onto said ITB when said image transfer nip is engaged.

8. The hybrid single pass, multi-pass full color printing system of claim 1, wherein each said image bearing member comprises a drum photoreceptor.

9. The hybrid single pass, multi-pass full color printing system of claim 1, wherein said plural number of selectable developer housings is mounted on a carousel assembly for indexing into and out of an image forming position relative to said image bearing member.

10. The hybrid single pass, multi-pass full color printing system of claim 9, wherein said plural number of selectable developer housings comprises 4 developer housings.

11. The hybrid single pass, multi-pass full color printing system of claim 1, wherein each said spot color developer is comprised of at least one high intensity colorant.

12. The hybrid single pass, multi-pass full color printing system of claim 1, including a programmable controller connected to each of said plurality of single pass image output modules and to said at least one single pass, multi-pass image output module.

13. The hybrid single pass, multi-pass full color printing system of claim 1, wherein said at least one single pass, multi-pass image output module comprises a first single pass, multi-pass image output module and a second single pass, multi-pass image output module.

14. The hybrid single pass, multi-pass full color printing system of claim 1, including a full color finished image transfer nip assembly for transferring full color images from said ITB onto finished image substrates.

15. The hybrid single pass, multi-pass full color printing system of claim 1, including a fusing station for fusing full color images onto finished image substrates.

16. The hybrid single pass, multi-pass full color printing system of claim 1, including a full color finished image transfer nip for transferring full color images from said ITB onto finished image substrates.

17. A hybrid single pass, multi-pass full color printing system comprising:

a) a machine frame;

b) a moveable intermediate transfer belt (ITB) mounted within said machine frame and having a path of movement;

c) Cyan, Magenta, Yellow and Black single pass image output modules mounted within said machine frame along said path of movement and each having imaging devices including an image carrying member and a single developer housing containing Cyan, magenta, Yellow and Black developer respectively for forming a respective color image in a single pass on said image carrying member for transfer onto said ITB; and d) one single pass, multi-pass image output module mounted along said path of movement downstream of said Cyan, Magenta, Yellow and Black single pass image output modules, said one single pass, multi-pass image output module being movable into and out of image transfer nip contact with said ITB, and said one single pass, multi-pass image output module having imaging devices including an image bearing member and a carousel development system having a plural number of indexable developer housings, and each of said indexable developer housings containing a single high intensity colorant color developer for forming spot color images in single passes and in multiple passes on said image bearing member for transfer onto said ITB.

18. The hybrid single pass, multi-pass full color printing system of claim 17, including a programmable controller connected to each of said plurality of single pass image output modules and to said one single pass, multi-pass image output module.

19. A hybrid single pass, multi-pass full color printing system comprising:

a) a machine frame;

b) a moveable intermediate transfer belt (ITB) mounted within said machine frame and having a path of movement;

c) Cyan, Magenta, Yellow and Black single pass image output modules mounted within said machine frame along said path of movement and each having imaging devices including an image carrying member and a single developer housing containing Cyan, magenta, Yellow and Black developer respectively for forming a respective color image in a single pass on said image carrying member for transfer onto said ITB;

d) a first single pass, multi-pass image output module mounted along said path of movement downstream of said Cyan, Magenta, Yellow and Black single pass image output modules, said first single pass, multi-pass image output module being movable into and out of image transfer nip contact with said ITB, and said first single pass, multi-pass image output module having imaging devices including an image bearing member and a carousel development system having a plural number of indexable developer housings, and each of said indexable developer housings containing a single high intensity colorant color developer for forming spot color images in single passes and in multiple passes on said image bearing member and for transfer onto said ITB; and e) a second single pass, multi-pass image output module mounted along said path of movement downstream of said Cyan, Magenta, Yellow and Black single pass image output modules, said second single pass, multi-pass image output module being movable into and out of image transfer nip contact with said ITB, and said second single pass, multi-pass image output module having imaging devices including an image bearing member and a carousel development system having a plural number of indexable developer housings, and each of said indexable developer housings containing a single high intensity colorant color developer for forming spot color images in single passes and in multiple passes on said image bearing member for transfer onto said ITB.

20. The hybrid single pass, multi-pass full color printing system of claim 19, including a programmable controller connected to each of said plurality of single pass image output modules and to said at least one single pass, multi-pass image output module.

* * * * *